US006102657A

United States Patent [19]

Chalberg et al.

[11] Patent Number: 6,102,657

[45] Date of Patent: Aug. 15, 2000

[54] SELF-DRAINING CENTRIFUGAL PUMP HAVING AN IMPROVED INLET

[75] Inventors: Philip E. Chalberg; Patrick B. Healy, both of Costa Mesa, Calif.

[73] Assignee: Hydrabaths, Inc., Santa Ana, Calif.

[21] Appl. No.: 09/188,456

[22] Filed: Nov. 9, 1998

[51] Int. Cl.[7] ..... F04D 29/44

[52] U.S. Cl. ..... 415/204; 415/206; 415/200; 415/915

[58] Field of Search ..... 415/203, 204, 415/206, 915, 182.1, 200, 208.1

[56] References Cited

U.S. PATENT DOCUMENTS 4,586,204 5/1986 Daniels ..... 4/542

5,156,535 10/1992 Budris et al. ..... 417/423.7

5,408,708 4/1995 Mathis ..... 5/541.4

5,930,852 8/1999 Gravatt et al. ..... 4/541.1

*Primary Examiner*—Edward K. Look

*Assistant Examiner*—Ninh Nguyen

*Attorney, Agent, or Firm*—Leonard Tachner

[57] ABSTRACT

A centrifugal pump for use in whirlpool bath systems has an offset inlet chamber configured to provide a smooth transition from inlet to impeller which is suitable for one-step injection molding using two opposed molding cores that may be removed from the inlet in opposite directions. The chamber has a double "D" profile with opposite flattened side surfaces. The cross-sectional area of the chamber decreases progressively between a larger offset inlet aperture and a smaller, centered entrance to the impeller. This configuration improves pumping efficiency while reducing noise.

11 Claims, 7 Drawing Sheets

SELF-DRAINING CENTRIFUGAL PUMP HAVING AN IMPROVED INLET

BACKGROUND OF THE INVENTION

1. Field of the Invention

The present invention relates generally to the field of whirlpool bath systems of the type having a plurality of venturi jets and a centrifugal pump. The invention relates more specifically to the centrifugal pump of such systems and to certain improvements which result in greater efficiency, reduced noise and easier fabrication.

2. Prior Art

A centrifugal pump design for whirlpool bathtubs has two areas of deviation from most pump designs. First is that the outlet is centered, rather than tangential, to allow the pump to be placed against the tub back slope in either direction. Secondly, the inlet is lowered and includes a passageway for the water that would normally remain in the volute to drain back into the suction (inlet) line when the bathtub is drained. Both of these design criteria create challenges in the design to gain optimal efficiency of the pump. Here we look at the second challenge and a resulting solution.

The challenge in the inlet design is due mainly from manufacturing considerations. A cost effective plastic injection mold requires that the internal features of the part be made on cores that pull out in orthogonal directions. This requirement contrasts strongly with the requirement that the shape of the inlet be a smooth transition from the lowered pump inlet to the impeller entrance. There should be no sharp points to create turbulence as the water passes. If the inlet diameter is larger than the impeller entrance diameter, the transition to the smaller diameter should be smooth and continuous along the skewed inlet axis without enlargements in cross section along the way. A design with either of these elements, while functional, will cause a loss of efficiency and produce undesirable noise.

SUMMARY OF THE INVENTION

The self-draining centrifugal pump inlet of the present invention comprises a double "D" profile with flattened sides. The width between the flattened sides is slightly less than the intersection of the diameter of the inlet and the diameter of the impeller entrance. Two skew flats of semicircular shape are provided on each side of the inlet. The resulting cross sections along the inlet axis are always decreasing in area. The resulting smooth transition from inlet to impeller, produces quiet and turbulence-free flow which raises pump efficiency and reduces pump noise.

OBJECTS OF THE INVENTION

It is therefore a principal object of the present invention to provide an improved pump inlet for whirlpool bath systems.

It is another object of the present invention to provide a whirlpool bath centrifugal pump which has improved efficiency.

It is still another object of the invention to provide a whirlpool bath centrifugal pump which has reduced noise.

It is yet another object of the invention to provide a whirlpool bath centrifugal pump which is easy to fabricate by injection molding.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 1 comprising

FIG. 3 comprising

DETAILED DESCRIPTION OF A PREFERRED EMBODIMENT

Figure 1A:
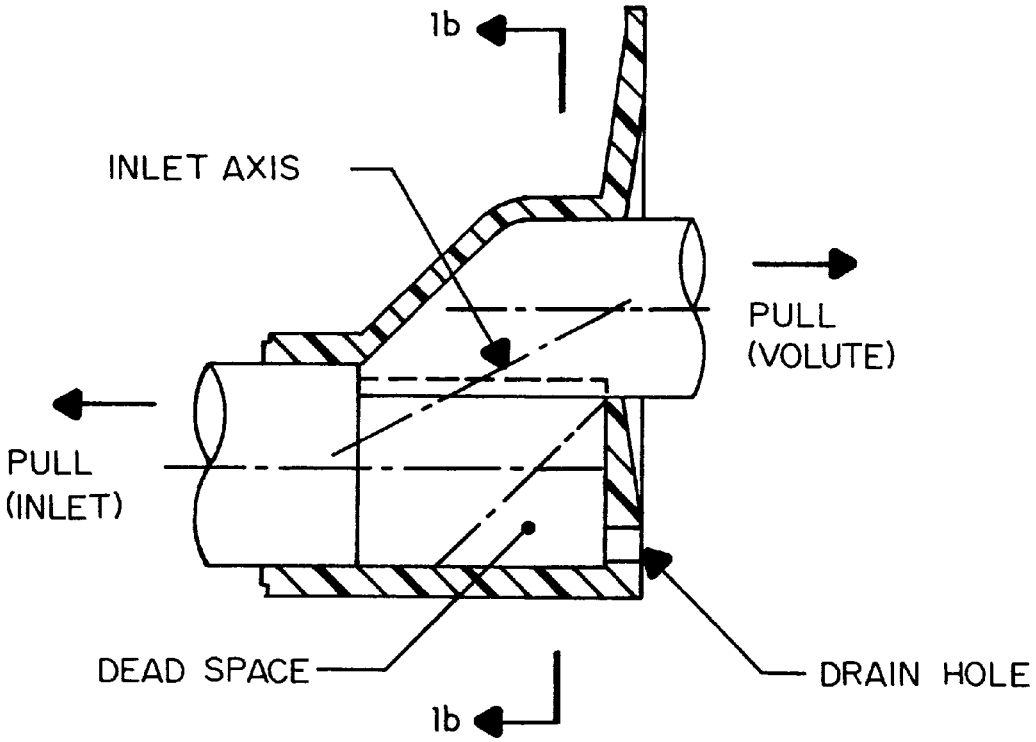
FIG. 1a (PRIOR ART)
FIGS. 1*a* and 1*b*, is an illustration of a first non-inventive pump inlet design used to explain the difficulties in avoiding turbulence and reducing noise.
Figure 1B:
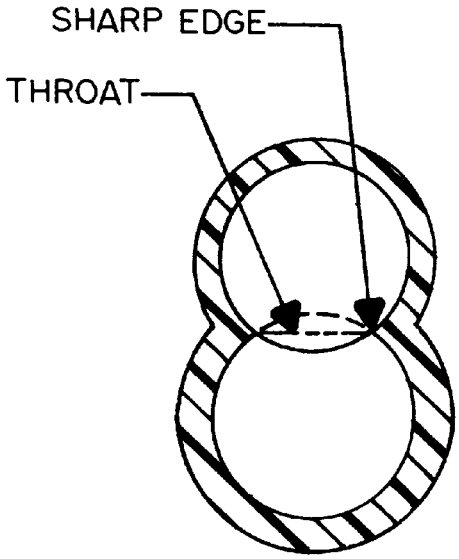
FIG. 1b (PRIOR ART)

FIGS. 1*a* and 1*b* show a non-inventive pump inlet design that is instructional as to the points made above.

This pump inlet is made from two simple round cores offset at the required distance so the drain hole at the bottom of the volute will let the water back into the pump inlet upon draining the whirlpool bath. The offset round cores intersect in a cross section with a figure eight or snowman shape. At the center of the shape is a narrow throat area with a sharp edge on each side. The flow area from the pump inlet to the impeller entrance along the skewed inlet axis will initially reduce in cross sectional area as it crosses the throat, and then expand closer to the impeller entrance. This, combined with the sharp edges, will produce noise and turbulence as the flow is forced to change velocity through the different sized areas. In addition, there is a large dead space in front of the drain hole where the flow path is not well constrained. In this area eddy currents will develop to further hinder smooth flow. To eliminate this problem, an insert with a second drain hole can be added (glued, welded, press-fit, etc.) in a secondary operation, as shown in FIG. 2.

This solution addresses the local flow problem, but does not resolve the throat area problems. It also has the disadvantage of adding the cost of producing and installing an additional component. As also can be seen from FIG. 2, it is not possible to integrally mold this insert, as the pocket that would be created from the right would adversely affect the volute geometry.

Figure 3A:
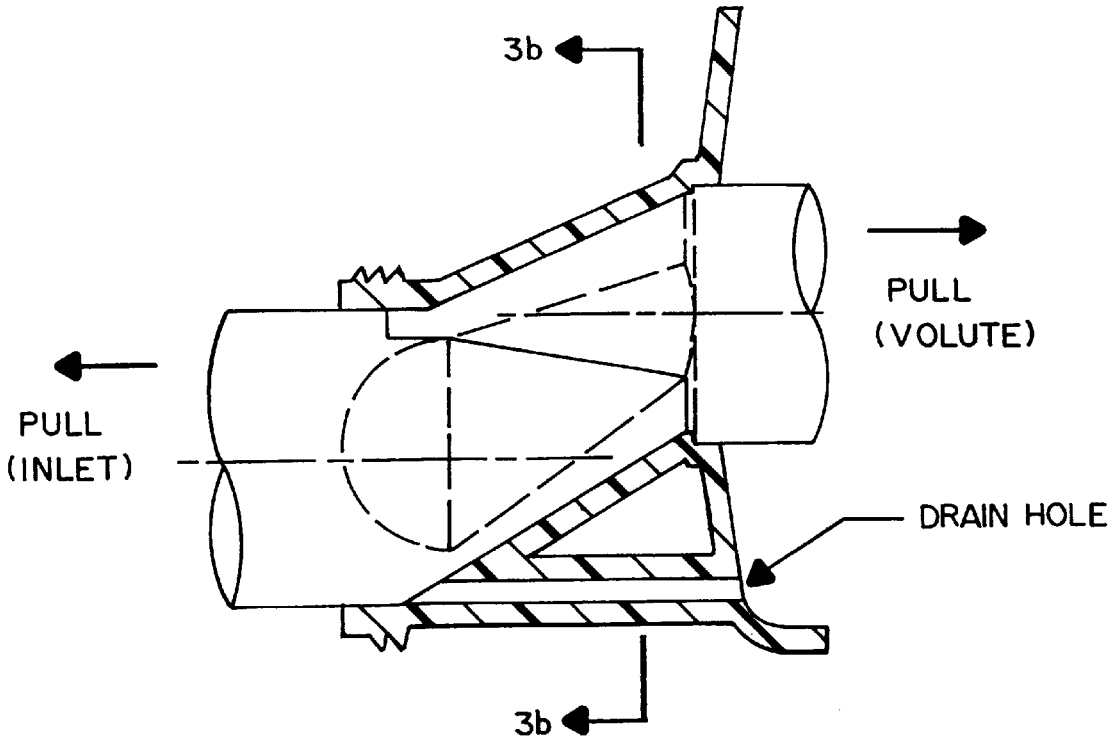
FIGS. 3*a* and 3*b*, is an illustration of a pump inlet design which is used to describe the present invention.
Figure 3B:
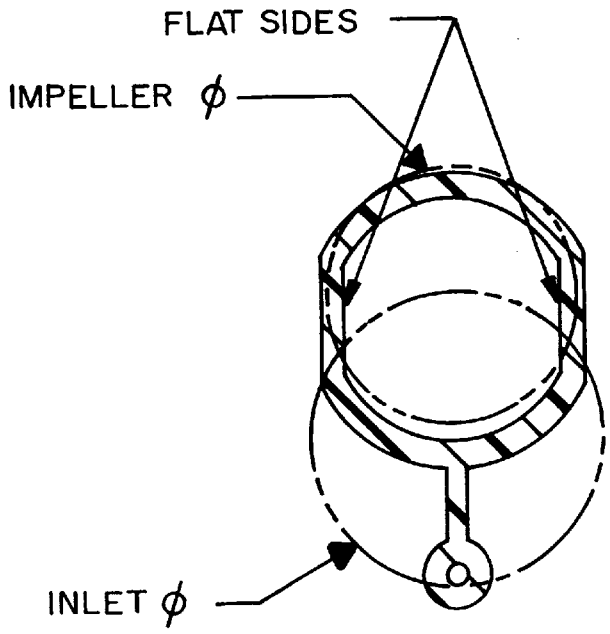
Figure 5:
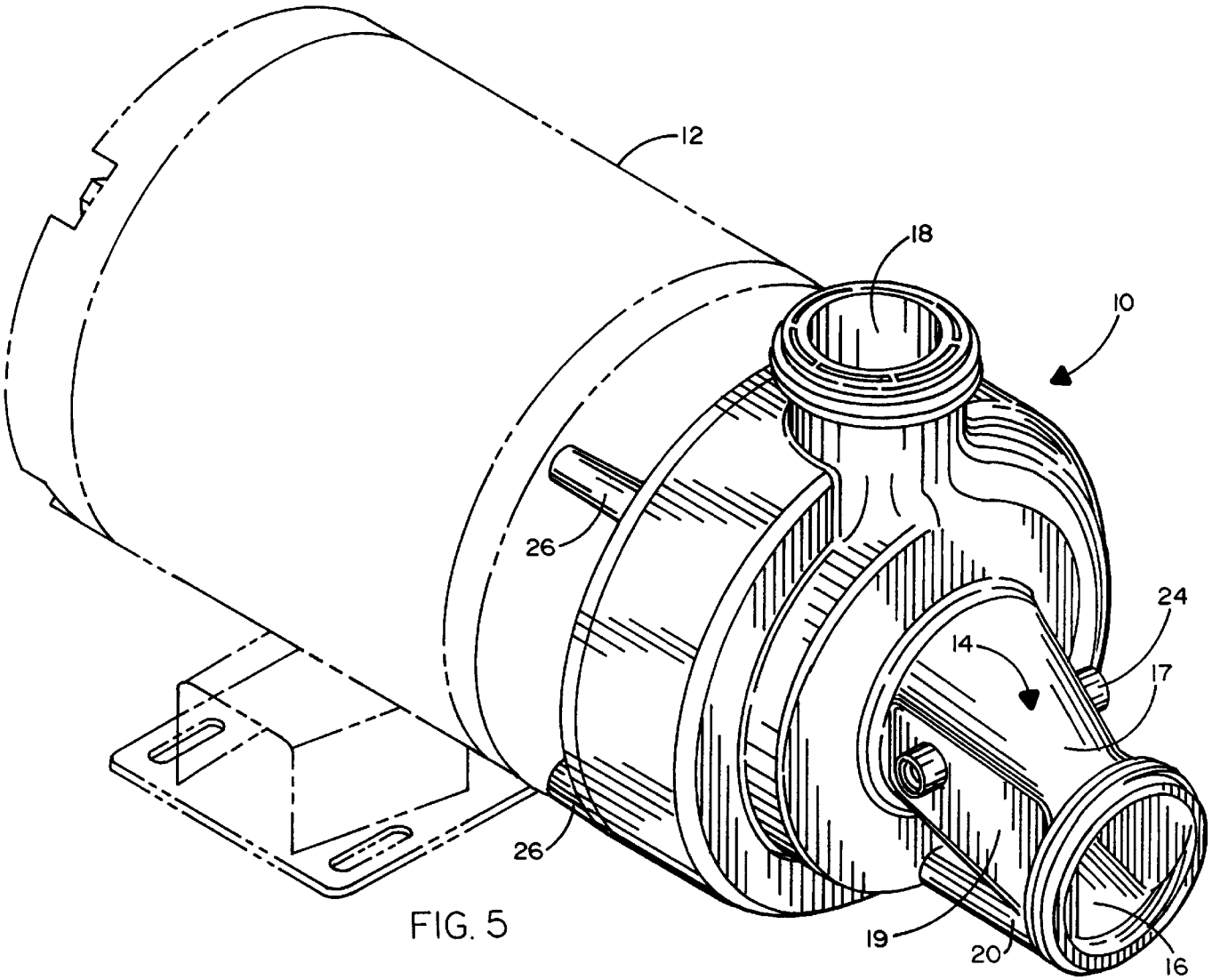
FIG. 5 is an isometric drawing of the pump of the invention, shown in its fully operational configuration connected to a suitable motor.
Figure 6:
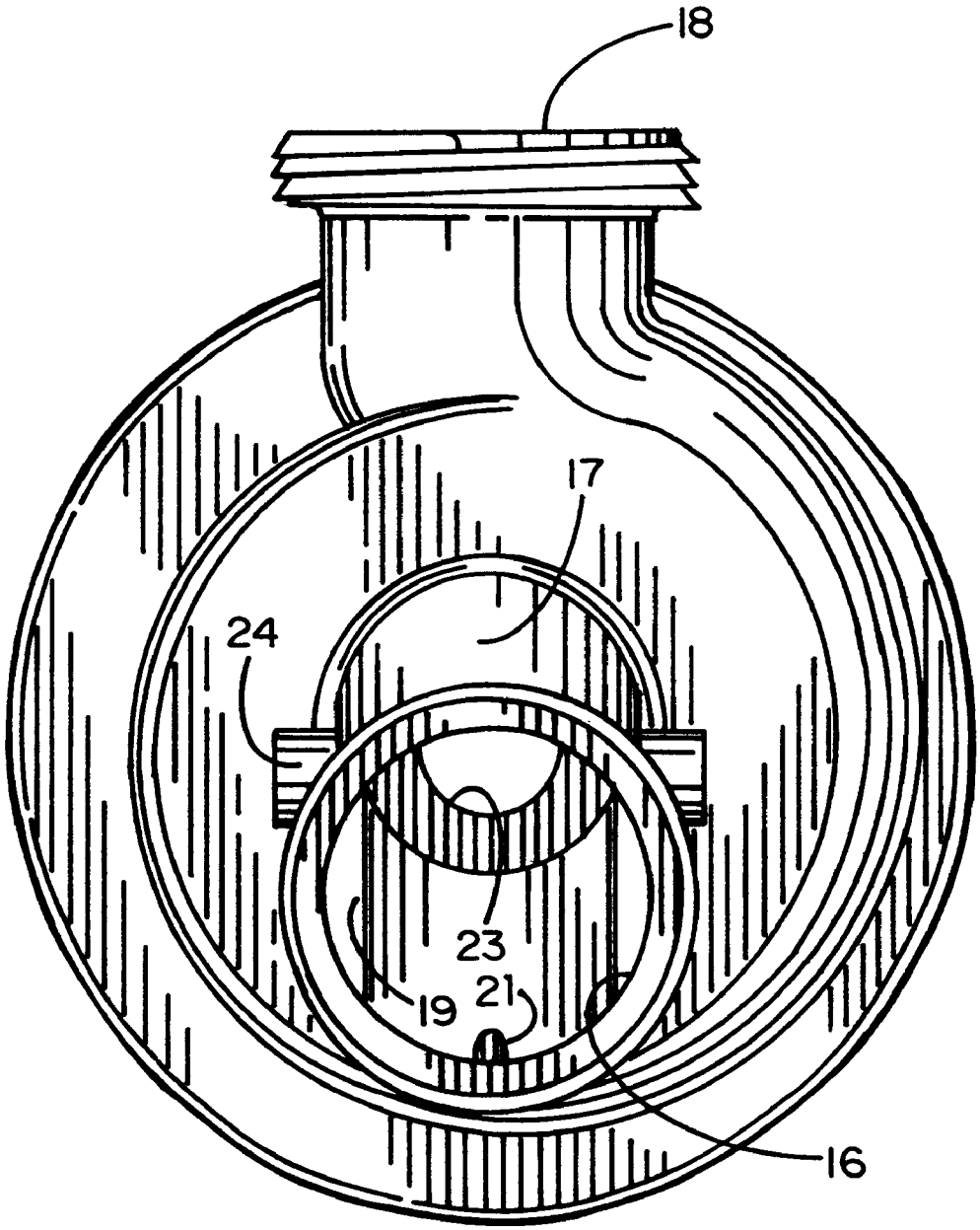
FIG. 6 is an elevational view of the inlet taken from the inlet side of the pump.
Figure 7:
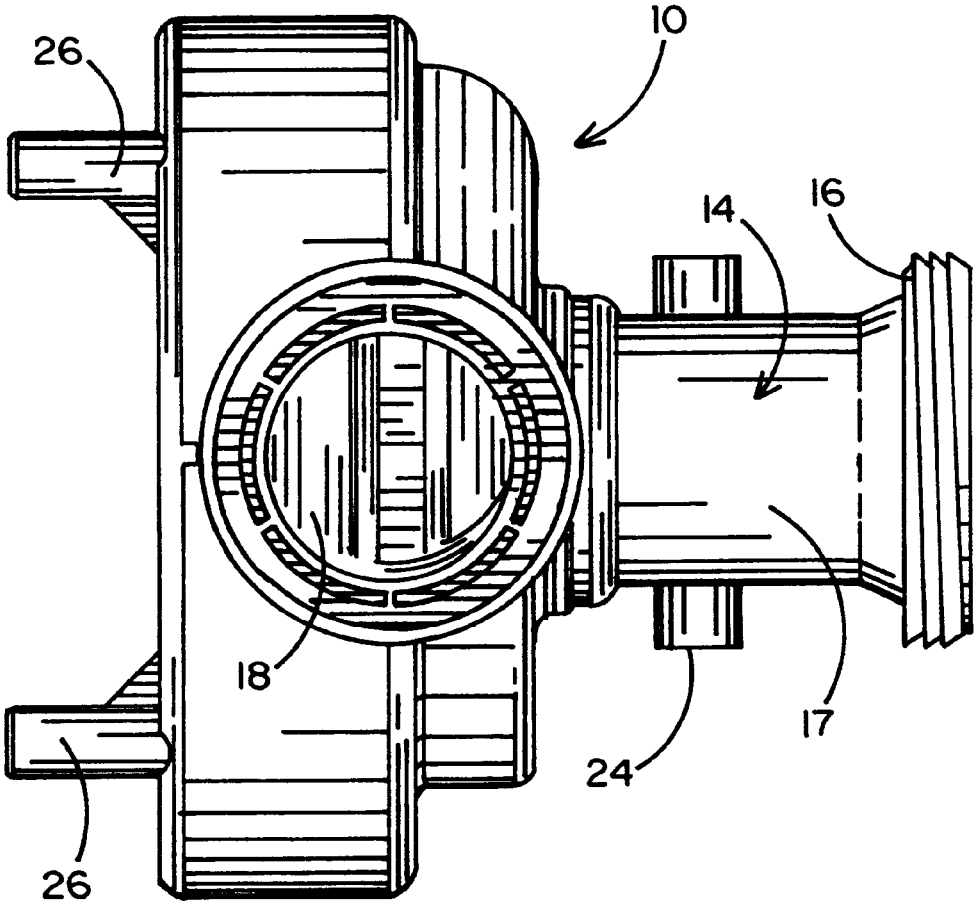
FIG. 7 is a top view of the pump.
Figure 8:
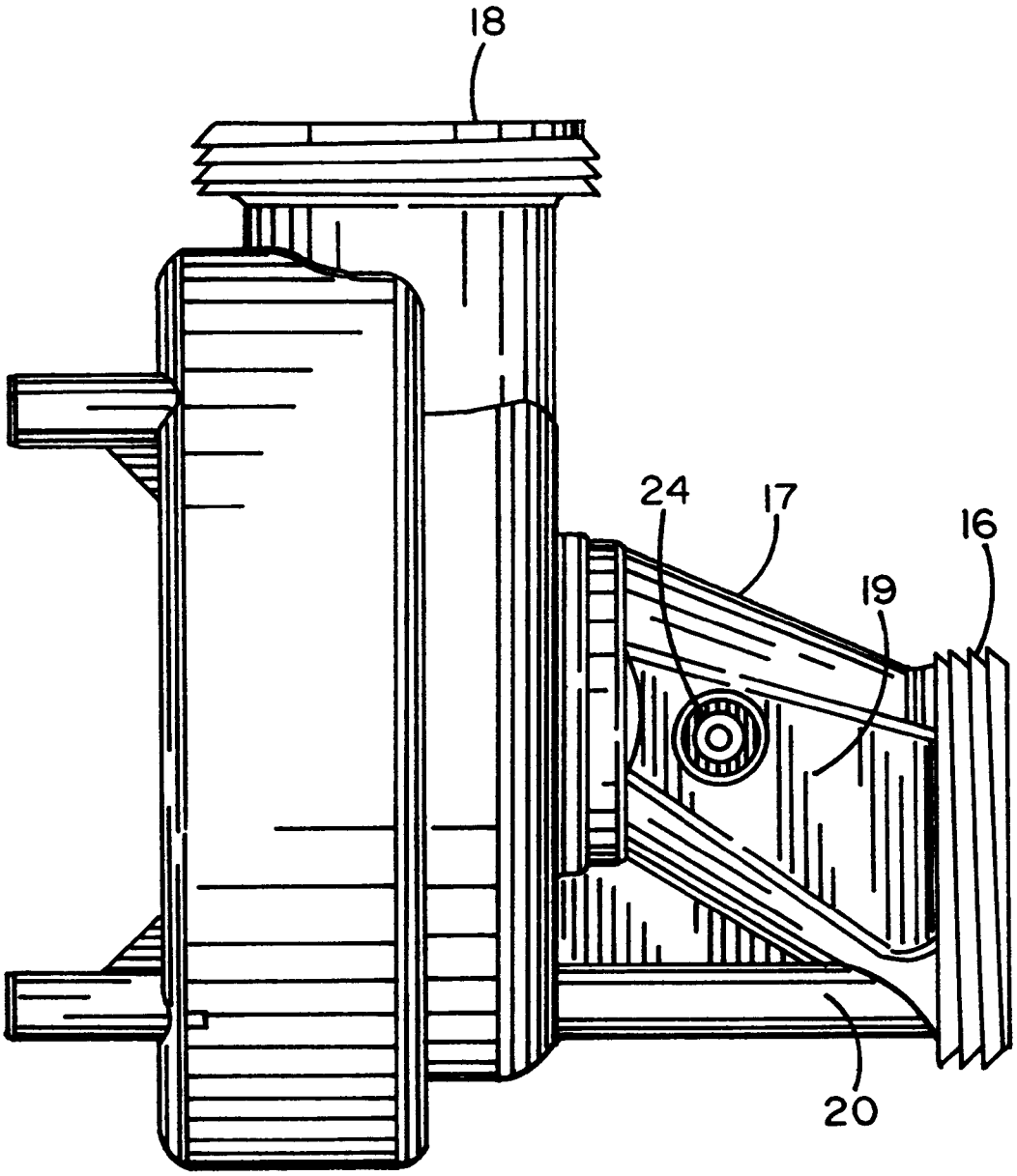
FIG. 8 is a side view of the pump.

FIGS. 3*a* and 3*b* show a design that addresses both the throat area and the dead space problems.

Figure 2:
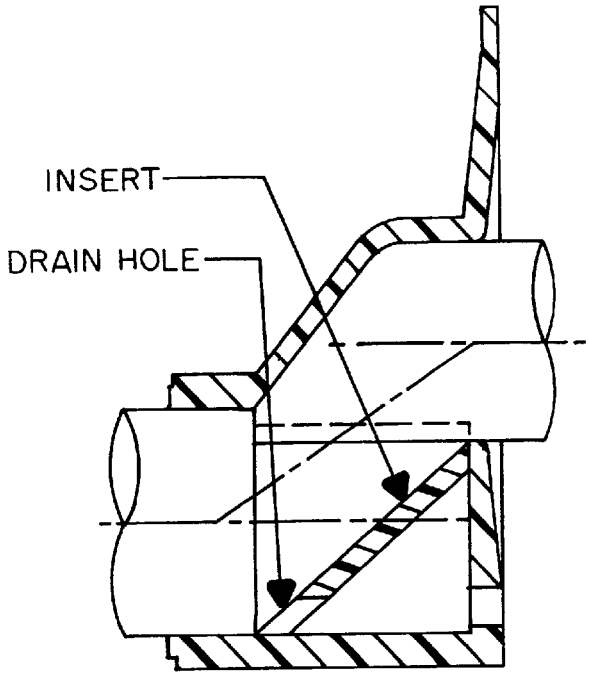
FIG. 2 (PRIOR ART)
FIG. 2 is an illustration of a second non-inventive pump inlet design used for the same purpose as FIG. 1.

The dead space is eliminated by shaping the underside of the inlet core to form one side of the insert shown in FIG. 2, and transforming the two drain holes shown in FIG. 2 into one long tube to connect the volute to the inlet. The remaining side of the insert is now the exterior of the part.

More importantly the shape of the pump inlet has been modified to eliminate the throat area by flattening the sides. The resulting cross section profile is a "double D" shape seen in FIG. 3*b*. The width between the flats is slightly less than the intersection of the inlet diameter and the impeller entrance diameter. Two skew flats of semicircular shape are made on each side of the inlet to transition to the flat sides.

Figure 4:
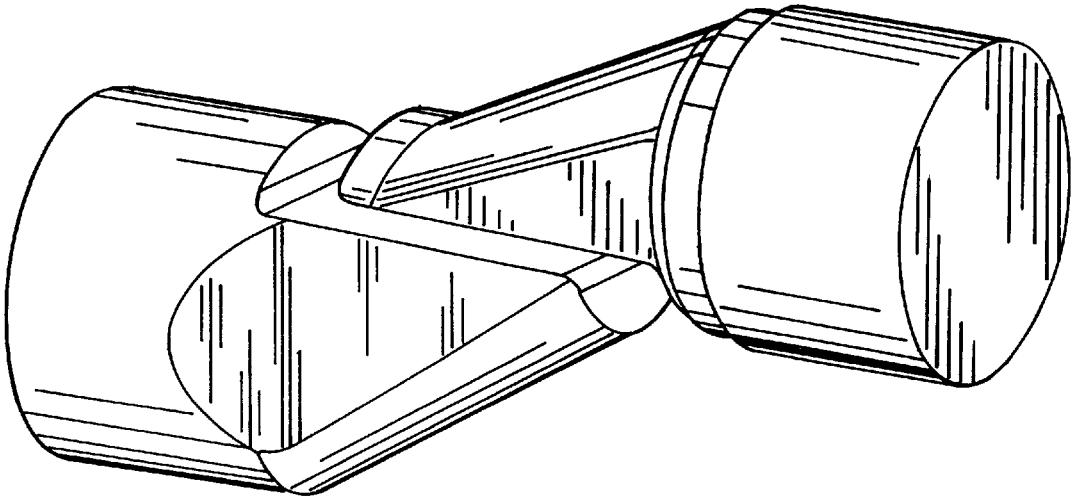
FIG. 4 is an isometric drawing of injection molding cores used to fabricate the pump inlet of FIG. 3.

The resulting cross sections along the inlet axis are always decreasing in area. To better visualize the pump inlet geometry, FIG. 4 shows an isometric view of the cores (slightly separated to show the parting line).

Testing has verified that this pump inlet produces quiet and turbulence free flow, and the volute drains as required. The success of the design is due to the fact that the sides have been flattened to remove the restricting throat area. Moreover, the pump inlet is produced without the necessity of an additional piece or secondary operation.

As seen in FIGS. 5 to 8, the preferred embodiment of the invention comprises a pump 10 having a motor 12. The pump comprises an inlet 14 forming a chamber 16 having a tapered top surface 17 and a pair of opposed flattened sides 19 leading to an impeller entrance 23. The pump also comprises an outlet 18, a drain tube 20 and a pair of tubes 24. Tubes 24 provide an air induction inlet which may be used to selectively inhibit pumping action despite continued rotation of the impeller. Tube 20 terminates in an aperture 21 within chamber 16 as seen best in FIG. 6. Also provided are symmetrically spaced connecting stems 26 which permit connection of the pump 10 to the motor 12. Moreover, it will be understood that between inlet chamber 16 and outlet 18 are a volute and an impeller (not shown) which are of conventional design.

Having thus described a preferred embodiment of the invention, it being understood that the disclosed embodiment is merely illustrative and not limiting of the scope hereof, what is claimed is:

1. An improved centrifugal pump for use in whirlpool bath systems, the pump having an axis and an electric motor with a shaft along the axis and the shaft turning an impeller in a volute, an offset inlet positioned below the axis for delivering water to the impeller and volute through an entrance along the axis and an outlet for transferring pressurized water to a whirlpool bath system; the improvement comprising:

an inlet chamber configured between said offset inlet and said entrance, said chamber forming a smooth transition from inlet to impeller and having a shape permitting one-step injection molding using two opposed cores that are removed from the molded inlet chamber in opposite parallel directions.

2. The improvement recited in claim 1 wherein the area of a cross-section along said inlet chamber is progressively smaller from said inlet to a location substantially adjacent said entrance.

3. The improvement recited in claim 1 wherein said inlet has a larger diameter than said entrance.

4. The improvement recited in claim 1 further comprising a drain channel between said volute and said inlet, said drain channel being positioned at a lower portion of said volute for substantially complete drainage of said volute upon deactivation of said pump and drainage of said whirlpool bath system.

5. An improved centrifugal pump for use in whirlpool bath systems, the pump having an axis and an electric motor with a shaft along the axis and the shaft turning an impeller in a volute, an offset inlet positioned below the axis for delivering water to the impeller and volute through an entrance along the axis and an outlet for transferring pressurized water to a whirlpool bath system; the improvement comprising:

an inlet chamber configured between said offset inlet and said entrance, said chamber forming a smooth transition from inlet to impeller and having a shape permitting one-step injection molding using two opposed cores that are removed from the molded inlet chamber in opposite directions;

wherein said chamber comprises an interior wall having upper and lower sections, the cross-sections of which are in the shape of circular segments and having side sections which are substantially flat.

6. The improvement recited in claim 5 wherein the distance between said substantially flat side sections is shorter than the intersection of said inlet and said entrance.

7. An improved centrifugal pump for use in whirlpool bath systems, the pump having an axis and an electric motor with a shaft along the axis and the shaft turning an impeller in a volute, an offset inlet positioned below the axis for delivering water to the impeller and volute through an entrance along the axis and an outlet for transferring pressurized water to a whirlpool bath system; the improvement comprising:

an inlet chamber configured between said offset inlet and said entrance, said chamber forming a smooth transition from inlet to impeller and having a shape permitting one-step injection molding using two opposed cores that are removed from the molded inlet chamber in opposite directions;

wherein said inlet and said entrance each have substantially circular cross-sections of unequal diameters, and wherein said chamber has cross-sections along substantially its entire length which are non-circular.

8. The improvement recited in claim 7 wherein said chamber cross-sections are progressively smaller in area from said inlet to entrance.

9. The improvement recited in claim 7 wherein said chamber cross-sections each have at least one flat surface.

10. The improvement recited in claim 9 wherein said chamber cross-sections each have two parallel straight surfaces.

11. An improved centrifugal pump for use in whirlpool bath systems, the pump having an axis and an electric motor with a shaft along the axis and the shaft turning an impeller in a volute, an offset inlet positioned below the axis for delivering water to the impeller and volute through an entrance along the axis and an outlet for transferring pressurized water to a whirlpool bath system; the improvement comprising:

an inlet chamber configured between said offset inlet and said entrance, said chamber forming a smooth transition from inlet to impeller and having a shape permitting one-step injection molding using two opposed cores that are removed from the molded inlet chamber in opposite directions;

further comprising an air induction tube connected to said chamber for effectively stopping pumping action without deactivating said motor.

* * * * *